United States Patent [19]

Chiklis et al.

[11] 4,367,277

[45] Jan. 4, 1983

[54] DIFFUSION TRANSFER PRODUCT AND PROCESS

[75] Inventors: Charles K. Chiklis, Lexington; Neil C. Mattucci, Billerica, both of Mass.

[73] Assignee: Polaroid Corporation, Cambridge, Mass.

[21] Appl. No.: 267,416

[22] Filed: May 26, 1981

[51] Int. Cl.[3] ..... G03C 7/00; G03C 5/54; G03C 1/40; G03C 1/48

[52] U.S. Cl. ..... 430/213; 430/212; 430/221; 430/227; 430/236; 430/244

[58] Field of Search ..... 430/212, 213, 215, 220, 430/221, 236, 227, 244

[56] References Cited

U.S. PATENT DOCUMENTS

| | | | |
|---|---|---|---|
| 3,698,896 | 10/1972 | Abbott | 430/213 |
| 3,706,557 | 12/1972 | Arond | 430/215 |
| 3,734,727 | 5/1973 | Milligan | 430/216 |
| 3,778,265 | 12/1973 | Land | 430/213 |
| 3,930,864 | 1/1976 | Abel et al. | 430/213 |
| 4,190,447 | 2/1980 | Coil et al. | 430/215 |
| 4,294,907 | 10/1981 | Bronstein-Bonte et al. | 430/213 |
| 4,298,674 | 11/1981 | Land et al. | 430/213 |

*Primary Examiner*—Richard L. Schilling
*Attorney, Agent, or Firm*—Stanley H. Mervis

[57] ABSTRACT

Diffusion transfer films and processes are disclosed wherein the processing composition includes a light-reflecting pigment and an optical filter agent, and the image-receiving layer carries over it a layer of unhardened gelatin adapted to decolorize optical filter agent immediately adjacent the interface between said processing composition and said decolorizing layer.

47 Claims, 1 Drawing Figure

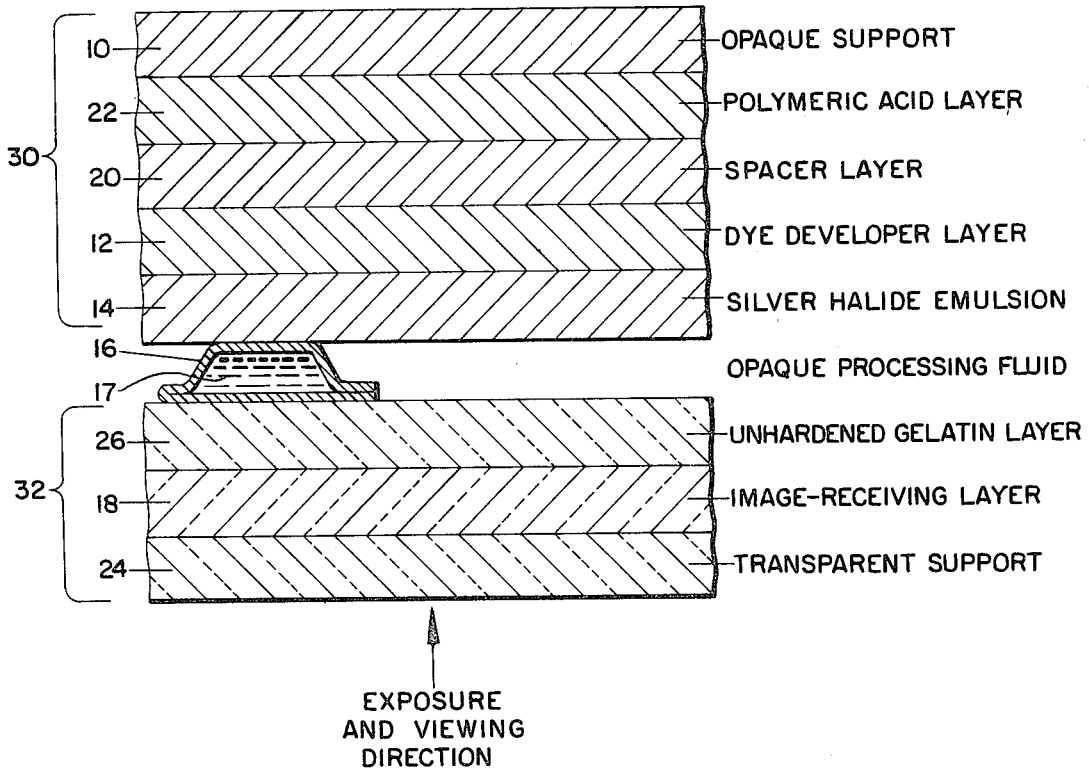
10
22
30
20
12
14
16
17
26
32
18
24
OPAQUE SUPPORT
POLYMERIC ACID LAYER
SPACER LAYER
DYE DEVELOPER LAYER
SILVER HALIDE EMULSION
OPAQUE PROCESSING FLUID
UNHARDENED GELATIN LAYER
IMAGE-RECEIVING LAYER
TRANSPARENT SUPPORT
EXPOSURE
AND VIEWING
DIRECTION

DIFFUSION TRANSFER PRODUCT AND PROCESS

This invention is concerned with photography and, more particularly, with photographic processes which are conducted outside of the camera in which the film is exposed.

U.S. Pat. No. 3,415,644 issued Dec. 10, 1958 to Edwin H. Land discloses photographic products and processes wherein a photosensitive element and an image-receiving element are maintained in fixed relationship prior to exposure, and this relationship is maintained as a laminate after processing and image formation. In these products and processes, the final image is viewed through a transparent (support) element against a reflection, i.e., white, background. Photoexposure is made through said transparent element and application of the processing composition provides a layer of light-reflecting material to provide a white background for viewing the final image through said transparent support. The light-reflecting material (referred to in said patent as an "opacifying agent") is preferably titanium dioxide, and it also performs an opacifying function, i.e., it is effective to mask the developed silver halide emulsions so that the transfer image may be viewed without interference therefrom, and it also helps to protect the photoexposed silver halide emulsions from post-exposure fogging by light passing through said transparent layer if the photoexposed film unit is removed from the camera before image-formation is completed.

U.S. Pat. No. 3,647,437, issued Mar. 7, 1972 to Edwin H. Land, discloses photographic products which may be processed outside of the camera in which the film is exposed, fogging of the film by ambient light being prevented by provision of one of more opacifying dyes, sometimes referred to as light-absorbing optical filter agents, appropriately positioned in the film unit after photoexposure. In a particularly useful embodiment of that invention, the film unit is a film unit of the type described in the aforementioned U.S. Pat. No. 3,415,644 and comprises first and second sheet-like elements, the first sheet-like element comprising an opaque base carrying a silver halide emulsion, and the second sheet-like element comprising a transparent support carrying an image layer, i.e., a layer adapted to receive an imagewise distribution of an image-forming material initially present in said first sheet-like element. After photoexposure a processing composition, adapted to develop the exposed silver halide emulsion and to form the desired image in said image layer, is distributed in a thin layer between said sheet-like elements. The processing composition contains a light-reflecting pigment, such as titanium dioxide, and at least one light-absorbing optical filter agent, such as a pH-sensitive phthalein dye which is colored at the initial pH of said processing composition. As disclosed in said U.S. Pat. No. 3,647,437, the concentrations of said light-reflecting pigment and said optical filter agent (s) are such that the layer of processing composition is sufficiently opaque to light actinic to the silver halide emulsion that the film unit may be ejected from the camera immediately after the processing composition is distributed, notwithstanding the fact that the second sheet-like element will transmit light incident on the surface thereof. This opacification system in quite effective and is employed in Polaroid Land SX-70 film. The light-absorbing capacity of the optical filter agent is discharged after this ability is no longer needed, so that the optical filter agent need not be removed from the film unit. Where the optical filter agent is a pH-sensitive dye, such as a phthalein indicator dye, it may be discharged or decolorized by reducing the pH after a predetermined time, e.g., by making available an acid-reacting material such as a polymeric acid.

In the preferred embodiments of the opacification system described in U.S. Pat. No. 3,647,437 the concentrations of the light-reflecting pigment and light-absorbing optical filter agent in the layer of processing composition will be such that that layer will have a transmission density of at least about 6 but a reflection density not greater than about 1. The presence of a long chain substituent, e.g., a long chain alkoxy group, on the optical filter agent is useful in reducing its diffusibility so that diffusion to the image-receiving layer is minimized.

A reflection density of about 1 will be recognized as very small compared with a transmission density of 6 or more for the same layer. In practice it has been possible to use a concentration of optical filter agents and titanium dioxide such that the reflection density of the processing composition layer, as measured about 30 seconds after distribution, is much lower than 1, e.g., about 0.5 to 0.6. While transferring dye and the emerging dye image may be seen at opacification system reflection densities of about 0.5, the presence of such temporary coloration of the highlight or white areas of the image, and the temporary distortion of the colors of the already transferring image dyes, is aesthetically undesirable.

As noted above, where the optical filter agent is a pH-sensitive dye, it is "discharged", i.e., rendered substantially colorless, by a reduction of the pH of the strata containing the optical filter agent. These strata include the light-reflecting pigment layer, provided by the processing composition, as well as the image-receiving layer and any other layers between the light-reflecting pigment layer and the transparent support through which the final image is viewed. This pH reduction is effected, to a pH level below the pKa of the optical filter agent, after a predetermined time. This delay is necessary in order that silver halide development be substantially completed before incident light is transmitted to the developing silver halide emulsions. Since the image dyes are preferably soluble and diffusible at the initial pH of the process but substantially nondiffusible at a lower pH, reduction of the pH to the appropriate lower pH after a predetermined period serves the very important function of controlling unwanted continued transfer of image dyes after the desired dye image has been formed.

It will be recognized that these desired results of pH reduction are only partly compatible, for early pH reduction to provide a white background early in the process could prematurely stop transfer of image dyes, resulting in a pale, i.e., low density, image which may also have an unbalanced color balance.

The copending applications of Edwin H. Land, Leon D. Cerankowski and Neil Mattucci, Ser. No. 143,293, filed Apr. 24, 1980 (now U.S. Pat. No. 4,298,674 issued Nov. 3, 1981) and of Irena Bronstein-Bonte, Edward P. Lindholm and Lloyd D. Taylor, Ser. No. 143,281 filed Apr. 24, 1980 (now U.S. Pat. No. 4,294,907 issued Oct. 13, 1981) disclose and claim diffusion transfer products and processes of the foregoing type where the background appears substantially white to the viewer, substantially immediately after the processing composition is applied while retaining opacification. As disclosed in said applications, it has been found that it is possible to significantly reduce the reflection density provided by the layer of processing composition containing the light-reflecting pigment and the optical filter agent without significantly reducing the transmission density thereof. This highly desirable improvement is obtained by decolorizing, substantially immediately after application of the processing composition, the optical filter agent immediately adjacent the interface between the processing composition and the layer of the second sheet-like element in contact with the processing composition. It is only necessary to decolorize a very small fraction of the applied optical filter agent in order to effectively render the interface substantially "white" when viewed by reflection. Since the reflection density is the result of light being absorbed twice by a given quantity of dye—once when the light enters and a second time when it is reflected back—it will be seen that decolorization of even a few molecules of dye adjacent the interface provides an effect which is so amplified by the optics of reflection that one can substantially lower the reflection density and increase the apparent whiteness of the layer of the processing composition providing the background against which the image is viewed without reducing the transmission density of the "white" layer to any significant extent.

The "decolorizing" layer is provided between the image-receiving layer and the layer of processing composition. This decolorizing layer comprises a substantially nondiffusible agent adapted to decolorize the small concentration of optical filter agent which is present immediately adjacent the interface between the processing composition and the decolorizing layer. This decolorizing is essentially limited to the optical filter agent which is present immediately adjacent the interface between the decolorizing layer and the processing composition. Even though the decolorizing layer is relatively thin it inhibits diffusion of optical filter agent into the image-receiving layer when it may react with the mordant to form a "new species" whose color is discharged only at a lower pH; e.g., the new species exhibits a much lower pKa and remains colored until the pH is reduced to a much lower level than otherwise would be required for decolorization. The remaining optical filter agent is discharged or decolorized by a subsequent pH reduction.

In the preferred embodiments of said copending applications, the decolorizing agent is a polyoxyalkylene polymer and the optical filter agent is a pH-sensitive phthalein dye.

The present invention provides an image-receiving element wherein a layer of unhardened gelatin coated over the image-receiving layer is effective as such a decolorizing layer. This effect was unexpected since unhardened gelatin does not decolorize the optical filter agent in the "test tube" test described in the above-mentioned copending application Ser. No. 143,293. Furthermore, the desired decolorizing effect is not obtained if the gelatin overcoat is hardened. While the precise mechanism by which unhardened gelatin acts as a decolorizing layer is not completely understood, it has been found to provide the decolorizing result described in said Ser. No. 143,293.

As indicated above, this invention is primarily directed to photographic processes wherein the desired image is obtained by processing an exposed photosensitive silver halide material, with a processing composition distributed between two sheet-like elements, one of said elements including said photosensitive material. The processing composition is so applied and confined within and between the two sheet-like elements as not to contact or wet outer surfaces of the superposed elements, thus providing a film unit or film packet whose external surfaces are dry. The processing composition is viscous and preferably is distributed from a single-use rupturable container; such pressure rupturable processing containers are frequently referred to as "pods". The final image may be black-and-white, monochrome or multicolor and either negative or positive with respect to the photographed subject. The present invention is especially, if not uniquely, adapted for facilitating processing outside of a camera film units which are maintained as an integral laminate after processing, the desired image being viewed through one face of said laminate.

In diffusion transfer embodiments of this invention the diffusible image-providing substance may be a complete dye or a dye intermediate, e.g., a color coupler. The preferred embodiments of this invention use a dye developer, that is, a compound which is both a silver halide developing agent and a dye disclosed in U.S. Pat. No. 2,983,606, issued May 9, 1961 to Howard G. Rogers. As is now well known, the dye developer is immobilized or precipitated in developed areas as a consequence of the development of the latent image. In unexposed and partially exposed areas of the emulsion, the dye developer is unreacted and diffusible and thus provides an imagewise distribution of unoxidized dye developer, diffusible in the processing composition, as a function of the point-to-point degree of exposure of the silver halide emulsion. At least part of this imagewise distribution of unoxidized dye developer is transferred, by imbibition, to a superposed image-receiving layer to provide a reversed or positive color image of the developed image. The image-receiving layer preferably contains a mordant for transferred unoxidized dye developer. As disclosed in the aforementioned U.S. Pat. Nos. 2,983,606 and 3,415,644, the image-receiving layer need not be separated from its superposed contact with the photosensitive element, subsequent to transfer image formation, if the support for the image-receiving layer, as well as any other layers intermediate said support and image-receiving layer, is transparent and a processing composition containing a substance, e.g., a white pigment, effective to mask the developed silver halide emulsion or emulsions is applied between the image-receiving layer and said silver halide emulsion or emulsions.

Dye developers, as noted above, are compounds which contain, in the same molecule, both the chromophoric system of a dye and also a silver halide developing function. By "a silver halide developing function" is meant a grouping adapted to develop exposed silver halide. A preferred silver halide development function is a hydroquinonyl group.

Multicolor images may be obtained using the color image-forming components, for example, dye developers, in an integral multi-layer photosensitive element, such as is disclosed in the aforementioned U.S. patents and in U.S. Pat. No. 3,345,163 issued Oct. 3, 1967 to Edwin H. Land and Howard G. Rogers. A suitable arrangement of this type comprises a support carrying a red-sensitive silver halide emulsion stratum, a green-sensitive silver halide emulsion stratum and a blue-sensitive silver halide emulsion stratum, said emulsions having associated therewith, respectively, for example, a cyan dye developer, a magenta dye developer and a yellow dye developer. The dye developer may be utilized in the silver halide emulsion stratum, for example in the form of particles, or it may be disposed in a stratum (e.g., of gelatin) behind the appropriate silver halide emulsion stratum. Each set of silver halide emulsion and associated dye developer strata preferably are separated from other sets by suitable interlayers. In certain instances, it may be desirable to incorporate a yellow filter in front of the green-sensitive emulsion and such yellow filter may be incorporated in an interlayer. However, if the yellow dye developer has the appropriate spectral characteristics and is present in a state capable of functioning as a yellow filter, a separate yellow filter may be omitted.

For convenience, further description of this invention will be in the context of the use of dye developers and positive transfer images.

The FIGURE illustrates in diagrammatic cross-section a film unit embodying the present invention and comprising a photosensitive element 30, an image-receiving element 32, and a rupturable container or pod 16 releasably holding a processing composition 17. For ease of understanding, the photosensitive element is shown as one containing a single silver halide emulsion and a single dye developer, the film unit thus providing a monochrome image.

Photosensitive element 30 is shown in superposed relationship with an image-receiving element 32, with a rupturable container 16 (holding an opaque processing composition 17) so positioned as to discharge its contents between said elements upon suitable application of pressure, as by passing through a pair of pressure applying rolls or other pressure applying means (not shown). Photosensitive element 30 comprises an opaque support 10 carrying a polymeric acid layer 22, a spacer layer 20, and a layer 12 of a dye developer over which has been coated a silver halide emulsion layer 14. The image-receiving element 32 comprises a transparent support 24 carrying, in turn, an image-receiving layer 18 and a layer 26 of unhardened gelatin. Photoexposure of the silver halide emulsion layer is effected through the transparent support 24 and the layers carried thereon, i.e., image-receiving layer 18 and layer 26, which layers are also transparent, the film unit being so positioned within the camera that light admitted through the camera exposure or lens system is incident upon the outer or exposure surface of the transparent support 24. After exposure the film unit is advanced between suitable pressure-applying members, rupturing the container 16, thereby releasing and distributing a layer of the opaque processing composition and thereby forming a laminate of the photosensitive element 30 and the image-receiving element 32 with their respective support members providing the outer layers of the laminate. The opaque processing composition contains a film-forming polymer, a white pigment and has an initial pH at which one or more optical filter agents contained therein are colored; the optical filter agent (agents) is (are) selected to exhibit the appropriate light absorption, i.e., optical density, over the wavelength range of light actinic to the particular silver halide emulsion(s). As a result, ambient or environmental light within that wavelength range incident upon the surface of transparent support surface and transmitted transversely through said transparent support and the transparent layers carried thereon in the direction of the exposed silver halide emulsion 14 is absorbed thereby avoiding further exposure of the photoexposed and developing silver halide emulsion 14. In exposed and developed areas, the dye developer is oxidized as a function of the silver halide development and immobilized. Unoxidized dye developer associated with undeveloped and partially developed areas remains mobile and is transferred imagewise to the image-receiving layer 18 to provide the desired positive image therein. Permeation of the alkaline processing composition through the spacer layer 20 to the polymeric acid layer 22 is so controlled that the process pH is maintained at a high enough level to effect the requisite development and image transfer and to retain the optical filter agent (agents) in colored form within the processing composition layer and on the silver halide emulsion side of said layer, after which pH reduction effected as a result of alkali permeation into the polymeric acid layer 22 is effective to reduce the pH to a level which changes the optical filter agent to a colorless form. Absorption of the water from the applied layer of the processing composition results in a solidified film composed of the film-forming polymer and the white pigment dispersed therein, thus providing a light-reflecting layer which also serves to laminate together the photosensitive component 30 and the image-receiving component 32 to provide the final integral image. The positive transfer image in dye developer present in the image-receiving layer 18 is viewed through the transparent support 24 against the light-reflecting layer which provides an essentially white background for the dye image and also effectively masks from view the developed silver halide emulsion 14 and dye developer immobilized therein or remaining in the dye developer layer 12.

The optical filter agent is retained within the final film unit laminate and is preferably colorless in its final form, i.e., exhibiting no visible absorption to degrade the transfer image or the white background therefor provided by the reflecting layer. The optical filter agent may be retained in the reflecting layer under these conditions, and it may contain a suitable "anchor" or "ballast" group to prevent its diffusion into adjacent layers. Some of the optical filter agent may diffuse into the photosensitive component and be mordanted by the gelatin or other material present on the silver halide emulsion side of the reflecting layer; optical filter mordanted in the photosensitive component 30 may be colorless or colored in its final state so long as any color exhibited by it is effectively masked by the reflecting layer. In the preferred embodiment, the photosensitive element contains hardened gelatin and the optical filter agent(s) is a pH-sensitive phthalein dye.

In the illustrated embodiment, photoexposure is effected through the image-receiving element. While this is a particularly useful and preferred embodiment, especially where the photosensitive element and the image-receiving element are secured together as shown in U.S. Pat. Nos. 3,415,644 and 3,647,437, it will be understood that the image-receiving element may be initially positioned out of the exposure path and superposed upon the photosensitive element after photoexposure.

A light-absorbing material optical filter agent, preferably a pH-sensitive dye such as an indicator dye, is provided so positioned and/or constituted as not to interfere with photoexposure but so positioned between the photoexposed silver halide emulsions and the transparent support during processing after photoexposure as to absorb light which otherwise might fog the photoexposed emulsions. Furthermore, the light-absorbing material is so positioned and/or constituted after processing as not to interfere with viewing the desired image shortly after said image has been formed. In the preferred embodiments, the optical filter agent is initially contained in the processing composition in colored form together with a light-reflecting material, e.g., titanium dioxide.

The concentration of indicator dye is selected to provide the optical transmission density required, in combination with other layers intermediate the silver halide emulsion layer(s) and the incident radiation, to prevent nonimagewise exposure, i.e., fogging, by incident actinic light during the performance of the particular photographic process. The transmission density and the indicator dye concentration necessary to provide the requisite protection from incident light may be readily determined for any photographic process by routine experimentation, as a function of film speed or sensitivity, processing time, anticipated incident light intensity, etc., as described in said U.S. Pat. No. 3,647,437. It will be recognized that a particular transmission density may not be required for all portions of the spectrum, lesser density being sufficient in wavelength regions corresponding to lesser sensitivities of the particular photosensitive material.

In a particularly useful embodiment, the light-absorbing dye is highly colored at the pH of the processing composition, e.g., 13–14, but is substantially nonabsorbing of visible light at a lower pH, e.g., less than 10–12. Particularly suitable are phthalein dyes having a pKa of about 13 to 13.5; many such dyes are described in the aforementioned U.S. Pat. No. 3,647,437. This pH reduction may be effected by an acid-reacting reagent appropriately positioned in the film unit, e.g., in a layer of the photosensitive element as shown in the FIGURE or in a layer between the transparent support and the image-receiving layer.

It will be understood that a mixture of light-absorbing materials may be used so as to obtain absorption in all critical areas of the visible and near-visible by which the silver halide emulsions, e.g., a panchromatic black-and-white silver halide emulsion or a multicolor silver halide photosensitive element, being used are exposable. Many dyes which change from colored to colorless as a function of pH reduction, e.g., phthalein dyes, are known and appropriate selection may be made by one skilled in the art to meet the particular conditions of a given process and film unit; such dyes are frequently referred to in the chemical and related arts as indicator dyes.

The mechanism by which the unhardened gelatin decolorizes the optical filter agent is not completely understood. It has been determined that it is not the result of a pH change. While it will be understood that applicants do not wish to be bound by any theory, applicants believe that the decolorization of the optical filter agent at the interface is the result of a rapid dehydration of a thin stratum of the processing composition in contact with the unhardened gelatin, this rapid dehydration causing a change in the local equilibria at the interface, thereby causing a decolorization of the optical filter agent at the interface. Experiments have demonstrated that the type of gelatin is not critical, but that the gelatin layer must not be hardened (cross-linked) or the decolorizing effect is substantially reduced.

Gelatins that have been found useful include inert bone gelatins, deionized gelatins, and derivatized gelatins (such as gelatins derivatized with phthalic anhydride or trimellitic anhydride). Both high and low isoelectric point gelatins have been found to be effective.

As noted above, the decolorizing layer comprises unhardened gelatin. If the layer over which it is coated, e.g., the image-receiving layer, is hardened (cross-linked) by agents that could harden gelatin, suitable precautions should be taken to avoid hardening the gelatin by diffusion thereto of hardening agent from the underlying layer. Such precautions include use of the minimum necessary concentration of hardener in the underlying layer, and waiting to coat the unhardened gelatin layer until sufficient time has elapsed to insure that the hardener has been substantially completely reacted. In general it has been found that a 24 hour wait before applying unhardened gelatin over a cross-linked image-receiving layer is adequate; the interval necessary to wait may be readily determined by routine experimentation with the materials to be utilized.

In certain embodiments it may be useful to provide a spacer layer, e.g., a layer of hydroxyethyl cellulose, between the unhardened gelatin layer and the underlying image-receiving layer. Use of such a spacer layer may facilitate the simultaneous coating of the layers. Such a spacer layer should be as thin as possible to minimize any reduction in transfer density. The unhardened gelatin layer may be applied as a single coating, as a series of sequential thin coatings or by the simultaneous application of several gelatin solutions varying in concentration and/or viscosity. Wetting agents and/or viscosity modifying materials may be included in the gelatin coating solutions in accordance with normal coating techniques, provided that normal precautions are taken to insure that the selected coating aid(s) has no detrimental effects.

The presence of a long chain substituent on the optical filter agent, e.g., phthalein dye, is preferred since this minimizes diffusion of the optical filter agent from the processing composition layer. In the preferred embodiments at least one of the phthalein dyes contains the grouping

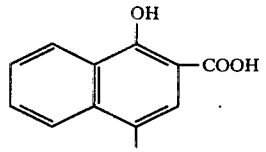

The coverage of unhardened gelatin effective for a given photographic system may be determined by routine experimentation. In general, unhardened gelatin coverages of about 50 to 200 mg/ft$^2$ have been found to be useful, with coverages of about 75 to 100 mg/ft$^2$ being preferred.

The following examples of image-receiving elements employing decolorizing layers in accordance with this invention are intended to be illustrative and are not intended to be limiting. All parts and percentages are by weight unless otherwise stated.

EXAMPLE 1

An image-receiving element was prepared by coating a transparent subcoated polyethylene terephthalate 4 mil (0.1 mm) support with the following layers:

1. an image-receiving layer coated at a coverage of about 300 mg/ft$^2$ (about 3330 mg/m$^2$) of a graft copolymer comprising 4-vinyl pyridine (4VP) and vinyl benzyl trimethyl ammonium chloride (TMQ) grafted onto hydroxyethyl cellulose (HEC) at a ration HEC/4VP/TMQ of 2.2/2.2/1, and about 2.5 mg/ft$^2$ of 1,4-butanediol diglycidyl ether cross-linking agent; and 2. a layer of unhardened inert bone gelatin coated at a coverage of about 100 mg/ft$^2$ (about 1076 mg/m$^2$).

EXAMPLE 2

An image-receiving element was prepared as described in Example 1 except that the unhardened gelatin was a phthalated bone gelatin.

EXAMPLE 3

An image-receiving element was prepared as described in Example 1 except that the unhardened gelatin was a deionized bone gelatin having an isoelectric point of about 4.8 to 5.0.

EXAMPLE 4

An image-receiving element was prepared as described in Example 1 except that the unhardened gelatin was an acid pigskin gelatin (not derivatized) having an isoelectric point of about 8.8.

EXAMPLES 5–8

Image-receiving elements were prepared as described in Examples 1–4, respectively, except that the coverage of the unhardened gelatin was about 75 mg/ft$^2$.

When the above described image-receiving elements were used in an integral multicolor diffusion transfer process of the Polaroid SX-70 type using the following cyan, magenta and yellow dye developers cyan:

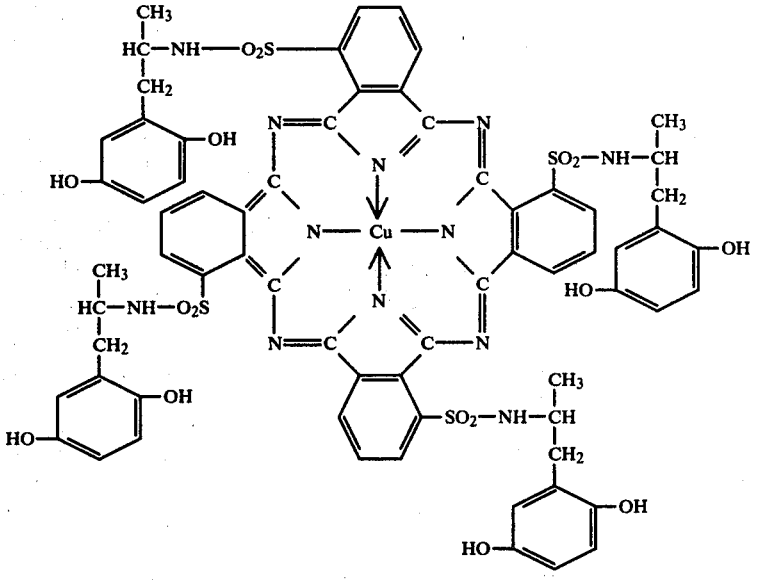

magenta:

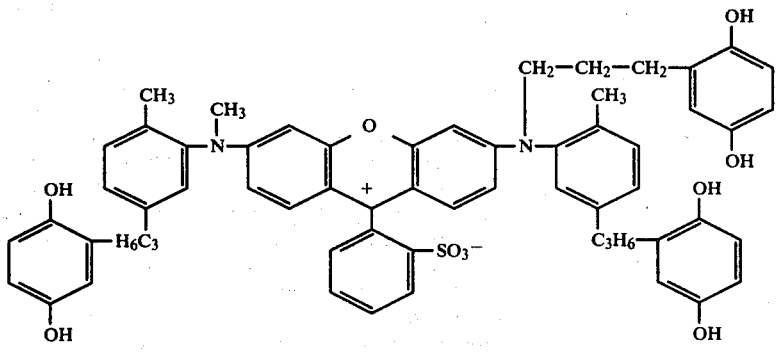

yellow:

-continued

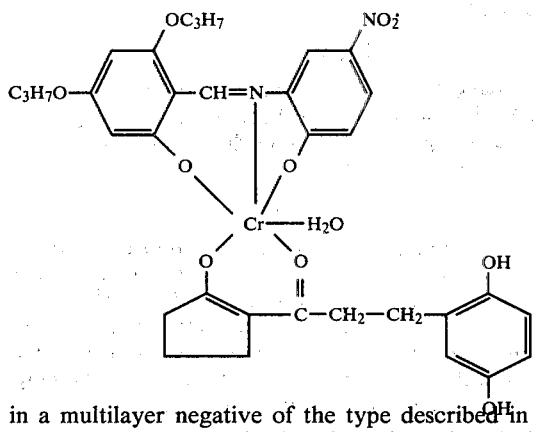

in a multilayer negative of the type described in said Ser. No. 143,293, and having the polymeric acid layer and spacer layer adjacent the opaque support as shown in the FIGURE of this application, using a layer approximately 0.0026 inch thick of a processing composition comprising:

| | |
|---|---|
| Water | 40.62 g. |
| Potassium hydroxide (100%) | 4.40 g. |
| Poly-diacetone acrylamide oxime | 0.67 g. |
| Titanium dioxide | 48.25 g. |
| Benzotriazole | 0.46 g. |
| 4-aminopyrazolo-(3,4d)-pyrimidine | 0.21 g. |
| 6-methyl uracil | 0.25 g. |
| N—2-hydroxyethyl-N,N',N'—tris-carboxymethyl-ethylene diamine | 0.63 g. |
| Polyethylene glycol (mol. wt. about 4000) | 0.375 g. |
| bis-(β-aminoethyl)-sulfide | 0.017 g. |
| Colloidal silica (30% dispersion) | 0.78 g. |
| N—phenethyl-α-picolinium bromide | 1.07 g. |
| 2-methyl imidazole | 0.50 g. |
| 5-bromo-6-methyl azabenzimidazole | 0.10 g. |
| 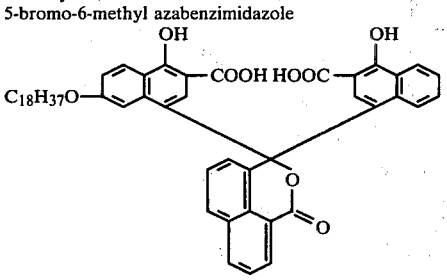 | 1.40 g. |
| 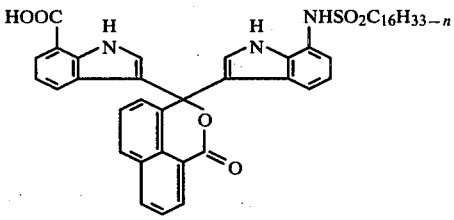 | 0.29 g. |

good multicolor transfer images were obtained. The background provided by the layer of titanium dioxide appeared apparently substantially white to the viewer within 2 to 3 seconds after the processing composition was distributed between the image-receiving element, demonstrating that the unhardened gelatin had been effective as a clearing layer to decolorize the phthalein opacifying dyes adjacent the interface.

It was found that the presence in the unhardened gelatin layers of a wetting agent, e.g., Triton X-100, or of a viscosity-modifying agent such as polyvinyl hydrogen phthalate did not interfere with the decolorizing effectiveness.

The unhardened gelatin layers of the above examples were optically clear, an advantageous property where photoexposure is effected therethrough.

It will be understood that the neutralizing layer 22 and timing layer 20 may be coated in the photosensitive element between the opaque support and the cyan dye developer layer, as described in U.S. Pat. No. 3,537,043 issued Mar. 30, 1971 to Edwin H. Land or between the transparent support 24 and the image-receiving layer 18, as described in the above-mentioned U.S. Pat. No. 3,415,644. Other techniques for controlling the pH known in the art also may be used.

The positive component 32 and the negative component 30 in the above examples were secured to each other along their marginal edges. It is also possible to temporarily laminate these elements to each other so that the unhardened gelatin layer 26 is in optical contact with the outer layer of the negative component 30. This bond should be of such a nature that these layers may be readily separated by the distribution of the processing composition following rupture of the pod 17. A particularly useful method of providing such a temporary lamination is to apply an aqueous solution of a polyethylene glycol, e.g., a polyethylene glycol having a molecular weight of about 6000 such as that commercially available under the tradename "Carbowax 6000" from Union Carbide Corporation. Such uses of polyethylene glycols are disclosed in U.S. Pat. No. 3,793,023 issued Feb. 19, 1974 to Edwin H. Land and to which reference may be made.

It is well known in the art that for in camera processing the processing composition should include a viscosity-increasing polymer of the type which, when the composition is spread and dried, forms a relatively firm and stable film. High molecular weight polymers are preferred, and include cellulosic polymers such as sodium carboxymethyl cellulose, hydroxyethyl cellulose and hydroxyethyl carboxymethyl cellulose. Another class of useful viscosity-increasing polymers comprises the oxime polymers disclosed and claimed in U.S. Pat. No. 4,202,694 issued May 13, 1980 to Lloyd D. Taylor. Suitable oxime polymers include polydiacetone acrylamide oxime as well as copolymers, e.g., oxinated poly diacetone acrylamide/acrylic acid, and oxinated graft copolymers, e.g., grafts of diacetone acrylamide oxime onto hydroxyethyl cellulose. It has been found that the decolorizing of the optical filter agent immediately adjacent the interface is particularly effective when the concentration of the viscosity-providing polymer is about 1% by weight or less, e.g., about 0.8% by weight as in the above examples.

Neutralizing layers such as the polymeric acid layer are well known in the art and are described in detail, for example, in the above-noted U.S. Pat. Nos. 3,415,644, 3,573,043 and 3,647,437 to which patents reference may be made.

It will be understood that use of the unhardened gelatin decolorizing layer alone, i.e., in the absence of a pH neutralizing mechanism, such as the polymeric acid layer, will not discharge or "clear" all of the pH-sensitive optical filter agent present. Thus, if the polymeric acid layer is omitted one observes that the optical filter agent adjacent the processing composition interface is decolorized but the color of the optical filter agent reappears after a period of time, presumably due to later diffusing optical filter agent.

This invention is applicable to a wide variety of photographic processes as will be readily apparent to one skilled in the art. Dye developers are preferred image-providing substances, as indicated above, and constitute an example of initially diffusible dye image-providing substances. Other useful dye image-providing substances include initially diffusible dyes useful as image dyes per se and which couple with the oxidation product of a silver halide developing agent to provide a non-diffusible product, initially diffusible color couplers which couple with the oxidation product of a silver halide developing agent to provide image dyes, initially non-diffusible compounds which react with the oxidation product of a silver halide developing agent, as by coupling or by cross-oxidation, to release a diffusible dye useful as an image dye per se. The final image may be formed as a result of the diffusion transfer of a soluble complex of undeveloped silver halide, in which event the image may be in silver as is well known. In another dye release system a soluble silver complex formed from undeveloped silver halide may be used to effect a cleavage reaction and release a dye or dye intermediate for transfer. Since these image-forming processes are well known and form no part per se of the present invention, it is not necessary to describe them in detail herein.

It will be understood that the transfer image may be positive or negative, with respect to the photographed subject matter, as a function of the particular image-forming system employed. The silver halide emulsion may be negative-working or positive-working (e.g., internal latent image) as appropriate for the particular imaging system.

For convenience, the disclosures of the aforementioned U.S. Pat. Nos. 3,415,644, 3,573,043 and 3,647,437 are expressly incorporated herein.

Since certain changes may be made in the above product and process without departing from the scope of the invention herein involved, the invention is not intended to be limited thereto but to include variations and modifications obvious to those skilled in the art and which are within the spirit of the invention and the scope of the appended claims.

What is claimed is:

1. A photographic process comprising providing a layer of a viscous aqueous alkaline processing composition between a first sheet-like element and a second sheet-like element; said first sheet-like element comprising an opaque support carrying an exposed silver halide emulsion; said second sheet-like element comprising a transparent support carrying an image-receiving layer; said processing composition comprising a light-reflecting pigment and at least one light-absorbing optical filter agent, said optical filter agent being a pH-sensitive dye; said application of said processing composition being effective to develop said exposed silver halide emulsion and to form a visible image in said image layer, the combination of said light-reflecting pigment and said optical filter agent being effective to prevent transmission through said processing composition layer of light actinic to said silver halide emulsion during development thereof; the layer of said second sheet-like element in contact with said processing composition layer comprising unhardened gelatin and adapted to reduce the light-absorbing ability of said optical filter agent immediately adjacent the interface between said layer and said processing composition without reducing the light-absorbing ability of said optical filter agent within said processing composition, whereby the transmission density of said processing composition layer is substantially unchanged but the surface of said processing composition layer viewable through said transparent support appears substantially white substantially immediately after said processing composition is applied.

2. A photographic process as defined in claim 1 wherein said pH-sensitive dye is a phthalein dye.

3. A photographic process as defined in claim 1 wherein said layer of unhardened gelatin is coated over said image-receiving layer.

4. A photographic process as defined in claim 2 wherein the remaining optical filter agent is decolorized by reducing the pH after a predetermined time subsequent to the decolorization of the said optical filter agent adjacent said interface.

5. A photographic process as defined in claim 1 wherein the concentrations of said optical filter agent and said light-reflecting pigment are effective to provide a transmission density of at least 6.

6. A photographic process as defined in claim 5 wherein the reflection density of said layer of processing composition has a reflection density not greater than about 1 in the absence of said decolorizing agent.

7. A photographic process as defined in claim 6 wherein said reflection density is not greater than about 0.5 to 0.6 in the absence of said decolorizing agent.

8. A photographic process as defined in claim 1 wherein said first sheet-like element contains hardened gelatin.

9. A photographic process as defined in claim 1 wherein said layer of unhardened gelatin is effective to reduce the red reflection density of said layer of processing composition to not more than about 0.35 within 10 seconds after said processing composition is applied.

10. A photographic process as defined in claim 1 wherein said optical filter agent contains a long chain substituent.

11. A photographic process as defined in claim 1 wherein said optical filter agent is a pH-sensitive phthalein dye containing a

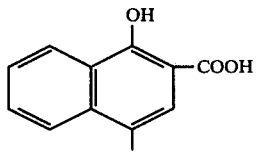

group.

12. A photographic process as defined in claim 1 wherein after a predetermined period subsequent to the decolorization of said optical filter agent adjacent said interface the pH of said processing composition layer is reduced to a pH effective to decolorize optical filter agent present in said layer, said pH reduction being effected by a neutralizing layer present in at least one of said sheet-like elements.

13. A photographic process as defined in claim 1 wherein said processing composition contains no more than about 1% by weight of a viscosity-providing polymer.

14. A photographic process as defined in claim 13 wherein said concentration of viscosity-providing polymer is about 0.8%.

15. A photographic process as defined in claim 13 wherein said viscosity-increasing polymer is a polymeric oxime.

16. A photographic process as defined in claim 13 wherein said viscosity-increasing polymer is hydroxyethyl cellulose.

17. A photographic process as defined in claim 1 wherein said visible image is a dye image.

18. A photographic process as defined in claim 17 wherein said dye is a dye developer.

19. A diffusion transfer process film unit including a first sheet-like element and a second sheet-like element, said first sheet-like element comprising an opaque support carrying a silver halide emulsion, said second sheet-like element comprising an image-receiving layer carried on a transparent support, said transparent support and the layers between it and said silver halide emulsion being transparent to radiation actinic to said silver halide emulsion; a viscous aqueous alkaline processing composition releasably contained in a rupturable container positioned to release said composition for distribution between said first and second sheet-like elements with said supports outermost, said processing composition including a light-reflecting pigment in a concentration effective to mask said photosensitive layer when said image-receiving layer is viewed through said transparent support; said processing composition also including an optical filter agent, said optical filter agent being a pH-sensitive dye which is light-absorbing at the pH of said processing composition, said optical filter agent being present in a concentration effective in combination with said pigment to provide a transmission density when distributed between said sheet-like elements effective to substantially prevent further exposure of said silver halide emulsion during the performance of the transfer process in an area of light actinic to said silver halide emulsion; said first sheet-like element including an image-providing material adapted to provide an image-forming material diffusible to said image-receiving layer as a function of said development, the layer of said second sheet-like element positioned to be in direct contact with said processing composition following distribution thereof comprising unhardened gelatin, said layer of unhardened gelatin being effective to decolorize optical filter agent immediately adjacent the interface between said processing composition and said decolorizing layer without substantially decreasing said transmission density, whereby the surface of said processing composition layer viewable through said transparent support appears substantially white substantially immediately after said processing composition is distributed.

20. A film unit as defined in claim 19, including a layer positioned in at least one of said sheet-like elements adapted after a predetermined time after said processing composition is distributed to provide an acid in a quantity effective to reduce the pH of said processing composition layer to a second pH at which said image-forming component is substantially nondiffusible.

21. A film unit as defined in claim 20 wherein said second pH is below the pKa of said optical filter agent.

22. A film unit as defined in claim 19 wherein the light-reflecting pigment is titanium dioxide.

23. A film unit as defined in claim 19 wherein the optical filter agent comprises a phthalein pH-sensitive dye possessing a pKa below the first pH and above the second pH.

24. A film unit as defined in claim 19 wherein said layer of unhardened gelatin is coated over said image-receiving layer.

25. A film unit as defined in claim 23 wherein the pH-sensitive dye is substantially nondiffusible from the layer of processing composition to the image-receiving layer.

26. A film unit as defined in claim 19 wherein said diffusible image-forming material is a dye.

27. A film unit as defined in claim 26 wherein said dye is a dye developer.

28. A film unit as defined in claim 19 wherein said diffusible image-forming material is a silver complex capable of forming a silver image in said image-receiving layer.

29. A film unit as defined in claim 20 wherein said acid-providing layer is a layer of a polymeric acid.

30. A film unit as defined in claim 29 wherein a polymeric acid layer is positioned between said transparent support and said image-receiving layer.

31. A film unit as defined in claim 29 wherein a polymeric acid layer is positioned in said first sheet-like element adjacent said opaque support.

32. A film unit as defined in claim 19 wherein said layer of unhardened gelatin is effective to reduce the red reflection density of said light-reflecting pigment layer to not greater than about 0.35 within ten seconds after said processing composition is applied.

33. A film unit as defined in claim 32 wherein the reflection density of said light-reflecting pigment layer is about 0.5 to 0.6 in the absence of said decolorizing agent.

34. A film unit as defined in claim 19 wherein said pH-sensitive dye is a phthalein dye.

35. A film unit as defined in claim 19 wherein the remaining optical filter agent is decolorized by reducing the pH after a predetermined time subsequent to the decolorization of the said optical filter agent adjacent said interface.

36. A film unit as defined in claim 19 wherein the concentrations of said optical filter agent and said light-reflecting pigment are effective to provide a transmission density of at least 6.

37. A film unit as defined in claim 19 wherein said first sheet-like element contains hardened gelatin.

38. A film unit as defined in claim 19 wherein said optical filter agent contains a long chain substituent.

39. A film unit as defined in claim 19 wherein said optical filter agent is a pH-sensitive phthalein dye containing a

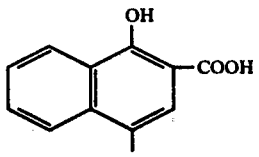

group.

40. A film unit as defined in claim 19 wherein said processing composition contains no more than about 1% by weight of a viscosity-providing polymer.

41. A film unit as defined in claim 40 wherein said concentration of viscosity-providing polymer is about 0.8%.

42. A film unit as defined in claim 40 wherein said viscosity-increasing polymer is a polymeric oxime.

43. A film unit as defined in claim 40 wherein said viscosity-increasing polymer is hydroxyethyl cellulose.

44. A film unit as defined in claim 19 wherein said image-receiving layer includes a quanternary ammonium polymeric mordant.

45. A film unit as defined in claim 19 wherein said first sheet-like element includes a blue-sensitive silver halide emulsion, a green-sensitive silver halide emulsion, and a red-sensitive silver halide emulsion, said silver halide emulsions having associated therewith, respectively, a yellow dye developer, a magenta dye developer and a cyan dye developer.

46. A film unit as defined in claim 19 wherein said unhardened gelatin is coated at a coverage of about 75 to 100 mg/ft$^2$.

47. A photographic process as defined in claim 1 wherein said unhardened gelatin is coated at a coverage of about 75 to 100 mg/ft$^2$.

* * * * *